US008302534B2

(12) United States Patent
Yang et al.

(10) Patent No.: US 8,302,534 B2
(45) Date of Patent: Nov. 6, 2012

(54) RADIAL-LINEAR SHAPED CHARGE PIPE CUTTER

(75) Inventors: Wenbo Yang, Sugar Land, TX (US); William T. Bell, Hunstville, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/698,631

(22) Filed: Feb. 2, 2010

(65) Prior Publication Data

US 2010/0132578 A1 Jun. 3, 2010

Related U.S. Application Data

(62) Division of application No. 10/961,350, filed on Oct. 8, 2004, now Pat. No. 7,661,367.

(51) Int. Cl.
*F42B 1/02* (2006.01)

(52) U.S. Cl. ..... 102/306; 102/307; 102/308; 102/310; 89/1.15

(58) Field of Classification Search ..... 102/306, 102/307, 310; 89/1.15
See application file for complete search history.

(56) References Cited

U.S. PATENT DOCUMENTS

| | | | | | |
|---|---|---|---|---|---|
| 2,684,030 | A * | 7/1954 | Muskat et al. | ..... | 102/307 |
| 2,839,997 | A * | 6/1958 | Church et al. | ..... | 102/307 |
| 3,013,491 | A * | 12/1961 | Poulter | ..... | 102/310 |
| 3,053,182 | A * | 9/1962 | Christopher | ..... | 175/4.6 |
| 3,057,295 | A * | 10/1962 | Christopher | ..... | 175/4.6 |
| 3,108,540 | A * | 10/1963 | Fletcher | ..... | 102/378 |
| 3,233,688 | A * | 2/1966 | Bell | ..... | 175/4.6 |
| 3,245,485 | A * | 4/1966 | Bell | ..... | 175/4.6 |
| 3,478,685 | A * | 11/1969 | Thomanek et al. | ..... | 102/306 |
| 4,354,433 | A * | 10/1982 | Owen | ..... | 102/307 |
| 4,425,850 | A * | 1/1984 | Grossler | ..... | 102/307 |
| 4,724,105 | A * | 2/1988 | Owen | ..... | 264/3.1 |
| 5,046,563 | A * | 9/1991 | Engel et al. | ..... | 166/297 |
| 5,129,322 | A * | 7/1992 | Christopher et al. | ..... | 102/202.3 |
| 5,377,594 | A * | 1/1995 | Alford | ..... | 102/308 |
| 5,385,098 | A * | 1/1995 | Lindqvist et al. | ..... | 102/205 |
| 5,698,814 | A * | 12/1997 | Parsons et al. | ..... | 102/478 |
| 6,016,753 | A * | 1/2000 | Glenn et al. | ..... | 102/307 |
| 6,298,913 | B1 * | 10/2001 | Box | ..... | 166/55 |
| 6,505,559 | B1 * | 1/2003 | Joslin et al. | ..... | 102/310 |
| 6,644,099 | B2 * | 11/2003 | Bell | ..... | 73/35.14 |
| 6,792,866 | B2 * | 9/2004 | Grattan | ..... | 102/310 |
| 6,840,178 | B2 * | 1/2005 | Collins et al. | ..... | 102/476 |
| 7,073,448 | B2 * | 7/2006 | Bell | ..... | 102/306 |
| 7,104,326 | B2 * | 9/2006 | Grattan et al. | ..... | 166/297 |
| 2002/0083860 | A1 * | 7/2002 | Shim | ..... | 102/306 |

* cited by examiner

*Primary Examiner* — Michelle Clement
(74) *Attorney, Agent, or Firm* — Chad Sullivan; Rodney Warfford; Jody Lynn Destefunis

(57) ABSTRACT

A radial-linear shaped charge pipe cutter is constructed with the booster explosive packed intimately into a booster aperture that is bored axially through the charge upper end plate. The cutter explosive is initiated at the interface between the upper margin of the cutter explosive and the contiguous inside surface of the upper end plate. This interface is within a critical initiation distance from the half charge juncture plane. In one embodiment, a half charge liner is configured as the assembly of two, coaxial, frusto-cones with the smaller cone diverging from the half charge juncture plane at a smaller angle than the outer cone. In another embodiment, the liner thickness increases from the juncture plane out to the liner perimeter.

4 Claims, 3 Drawing Sheets

RADIAL-LINEAR SHAPED CHARGE PIPE CUTTER

CROSS-REFERENCE TO RELATED APPLICATIONS

This application is a Divisional of U.S. patent application Ser. No. 10/961,350, filed Oct. 8, 2004 incorporated by reference herein.

STATEMENT REGARDING FEDERALLY SPONSORED RESEARCH OR DEVELOPMENT

Not Applicable

BACKGROUND OF THE INVENTION

1. Field of the Invention

The present invention relates to shaped charge tools for explosively severing tubular goods including, but not limited to, pipe, tubing, production/casing liners and/or casing.

2. Description of Related Art

The capacity to quickly, reliably and cleanly sever a joint of tubing or casing deeply within a wellbore is an essential maintenance and salvage operation in the petroleum drilling and exploration industry. Generally, the industry relies upon mechanical, chemical or pyrotechnic devices for such cutting. Among the available options, shaped charge (SC) explosive cutters are often the simplest, fastest and least expensive tools for cutting pipe in a well. The devices are typically conveyed into a well for detonation on a wireline or length of coiled tubing.

Typical explosive pipe cutting devices comprise a consolidated wheel of explosive material having a V-groove perimeter. The circular side faces of the explosive wheel are intimately formed against circular metallic end plates. The external surface of the circular V-groove is clad with a thin metal liner. An aperture along the wheel axis provides a receptacle path for a detonation booster.

This V-grooved wheel of shaped explosive is aligned coaxially within a housing sub and the sub is disposed internally of the pipe cutting subject. Accordingly, the plane that includes the circular perimeter of the V-groove apex is substantially perpendicular to the pipe axis.

When detonated at the axial center, the explosive shock wave advances radially along the apex plane against the V-groove liner to drive the opposing liner surfaces together at an extremely high velocity of about 30,000 ft/sec. This high velocity collision of the V-groove liner material generates a localized impingement pressure within the material of about 2 to $4\times10^6$ psi. Under pressure of this magnitude, the liner material is essentially fluidized.

Due to the V-groove geometry of the liner material, the collision reaction includes a lineal dynamic vector component along the apex plane. Under the propellant influence of the high impingement pressure, the fluidized mass of liner material flows lineally and radially along this apex plane at velocities in the order of 15,000 ft/sec. Resultant impingement pressures against the surrounding pipe wall may be as high as 6 to $7\times10^6$ psi thereby locally fluidizing the pipe wall material.

Traditional fabrication procedures for shaped charge pipe cutters have included an independent fabrication of the liner as a truncated cone of metallic foil. The transverse sections of the cone are open. In a forming mold with the liner serving as a bottom wall portion of the mold, the explosive is formed or molded against the concave conical face of the liner. At the open center of the truncated apex of the liner, the explosive is formed against the mold bottom surface and around a cylindrical core.

With the precisely desired explosive material in place, an end plate is aligned over the cylindrical core and pressed against the upper surface of the explosive material at a controlled rate and pressure in the manner of a press platen. When removed from the forming mold, the unified liner-explosive-backing plate comprises half of a shaped charge pipe cutter.

To complete a full cutter unit, two of the shaped charge half sections, separated from the cylindrical core mold, are joined along a common axis at a contiguous juncture plane of exposed explosive at the truncated apex face planes. A detonation booster is inserted along the open axial bore of the unit left by the molding core. This detonation booster traverses the half charge juncture plane to bridge the explosive charges respective to the two half sections between the opposing end plates. The charged cutter is inserted into a cutter housing that is secured to a cutter sub.

Over years of experience, use and experimentation, the explosion dynamics of shaped charge cutters has evolved dramatically. Some prior notions of critical relationships have been revealed as not so critical. Other notions of insignificance have been discovered to be of great importance. The summation of numerous small departures from the prior art traditions has produced significant performance improvements or significant reductions in fabrication expense.

BRIEF SUMMARY OF THE INVENTION

The present invention pipe cutter comprises several design and fabrication advantages that include a half cutter fabrication procedure that compresses the booster explosive material intimately into an axially centered aperture that is bored through the upper charge end plate. In this embodiment of the invention, there is no independently prepared booster that is an article separate from the end plate. The booster initiates the cutter explosive charge at a plane common with inner surface plane of the end plate. Although the initiation point is lateral of the half cutter junction plane, the point of explosive initiation is within a critical initiation distance from the juncture plane and nevertheless produces a symmetric shock wave impact on the opposing liner faces.

Another, similar embodiment of the invention has a tapered wall for the upper backing plate booster aperture. The taper converges from the exterior surface of the upper backing plate toward the cutter explosive at about 5°. The small, terminus end of the aperture coincides with the upper surface plane of the cutter explosive.

A bi-axial liner embodiment of the invention configures the liner of a half charge as a pair of coaxial cone frustums of different conical angles. The base edge of the inner cone is joined to the apex edge of the outer cone. The inner cone frustum that diverges from the half charge juncture plane is formed to a greater conical angle than the outer cone frustum.

Another embodiment of the invention is a charge liner having a tapered thickness. The liner thickness increases from the half charge juncture plane out to charge perimeter by a surface angle divergence of about 0.50° to about 1.50°.

A further embodiment of the invention comprises a thin wall tube for the booster explosive that is inserted into an axial aperture in the upper backing plate. The length of the booster tube is terminated at or above the half charge juncture plane. The inside face of the upper backing plate is configured to provide a boss extension around the booster aperture.

BRIEF DESCRIPTION OF THE SEVERAL VIEWS OF THE DRAWINGS

The invention is hereafter described in detail and with reference to the drawings wherein like reference characters designate like or similar elements throughout the several figures and views that collectively comprise the drawings. Respective to each drawing figure.

DETAILED DESCRIPTION OF THE INVENTION

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
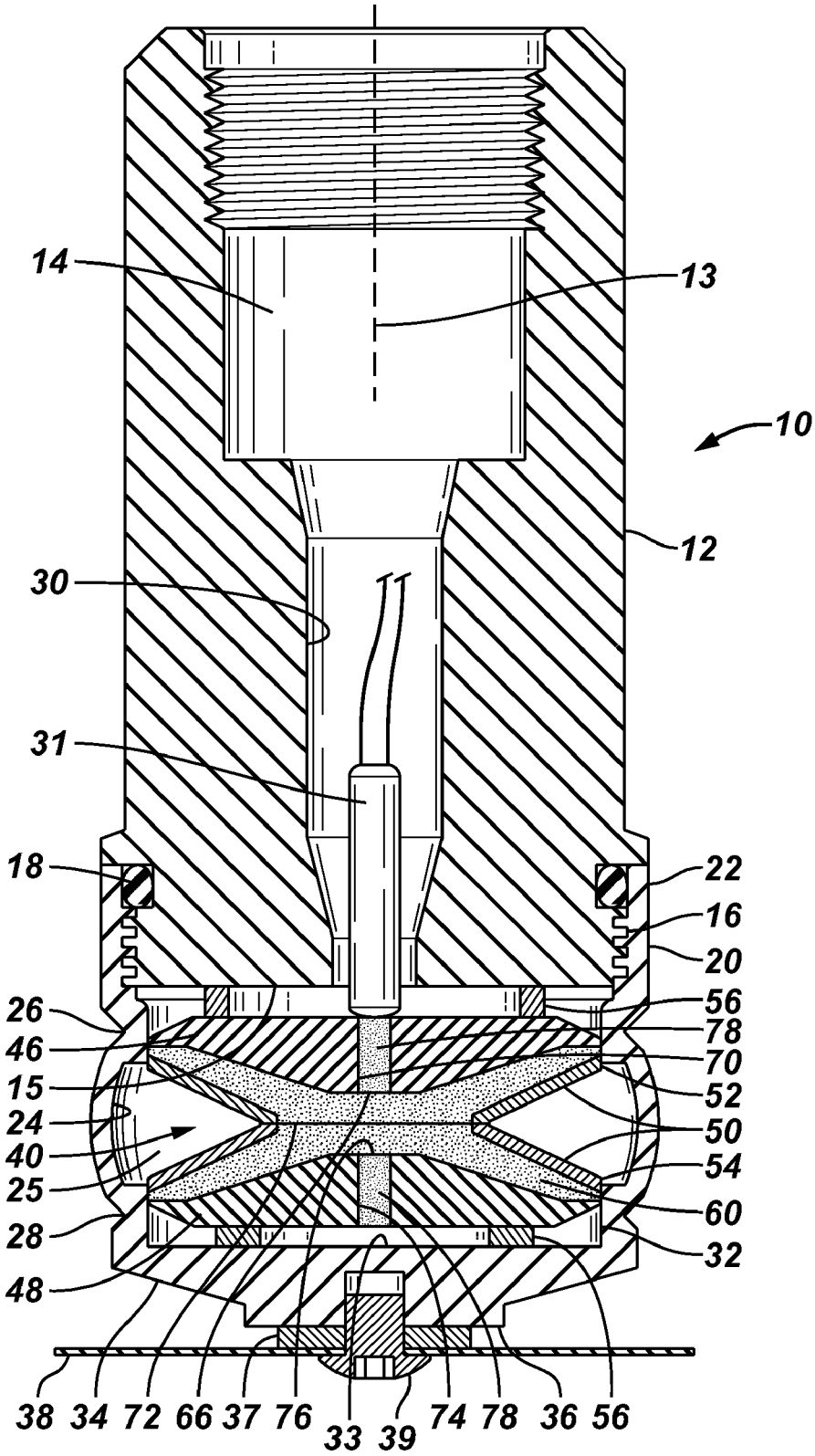
FIG. 1 is a cross-section of a first embodiment of the invention in assembly with the housing, centralizer and connecting sub.

Referring initially to the invention embodiment of FIG. 1, the cutter assembly 10 comprises a top sub 12 having a threaded internal socket 14 that axially penetrates the "upper" end of the top sub. The socket thread 14 provides a secure mechanism for attaching the cutter assembly with an appropriate wire line or tubing suspension string not shown. In general, the cutter assembly has a substantially circular cross-section. Consequentially, the outer configuration of the cutter assembly is substantially cylindrical. The "lower" end of the top sub includes a substantially flat end face 15. The end face perimeter is delineated by a housing assembly thread 16 and an O-ring seal 18. The axial center 13 of the top sub is bored between the assembly socket 14 and the end face 15 to provide a socket 30 for a booster detonator 31.

The cutter housing 20 is secured to the top sub 12 by an internally threaded sleeve 22. The O-ring 18 seals the interface from fluid invasion of the interior housing volume. A jet window section 24 of the housing interior may be axially delineated above and below by exterior "break-up grooves" 26 and 28. The break-up grooves are lines of weakness in the housing 20 cross-section and may be formed within the housing interior as well as exterior as illustrated. The jet window 24 is that inside wall portion of the housing 20 that bounds the jet cavity 25 around the shaped charge between the outer or base perimeters 52 and 54 of the liners 50. Preferably, the upper and lower limits of the jet window 25 are coordinated with the shaped charge dimensions to place the window "sills" at the approximate mid-line between the inner and outer surfaces of the liner 50.

Below the lower break-up groove 28, the cutter housing cavity is internally terminated by an integral end wall 32 having a substantially flat internal end-face 33. The external end-face 34 of the end wall may be frusto-conical about a central end boss 36. A hardened steel centralizer 38 is secured to the end boss by an assembly bolt 39. A spacer 37 may be placed between the centralizer and the face of the end boss 36 as required by the specific task. Preferably, the shaped charge housing 20 is a frangible steel material of approximately 55-60 Rockwell "C" hardness.

The shaped charge assembly 40 is preferably spaced between the top sub end face 15 and the internal end-face 33 of the end wall 32 by a resilient, electrically non-conductive, ring spacer 56. An air space of at least 0.100" between the top sub end face 15 and the adjacent face of the cutter assembly thrust disc 44 is preferred. Similarly, a resilient, non-conductive lower ring spacer 56 provides an air space of at least 0.100" between the internal end-face 33 and the adjacent cutter assembly lower end plate 48.

Loose explosive particles can be ignited by impact or friction in handling, bumping or dropping the assembly. Ignition that is capable of propagating a premature explosion may occur at contact points between a steel, shaped charge end plate 46 or 48 and a steel housing 20. To minimize such ignition opportunities, the upper end plate 46, for the present invention, are preferably fabricated of non-sparking brass.

Figure 6:
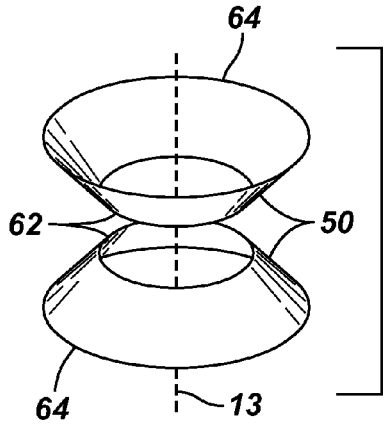
FIG. 6 is an exploded view pictorial of a cooperative pair of liners.

The explosive material 60 traditionally used in the composition of shaped charge tubing cutters comprises a precisely measured quantity of powdered explosive material such as RDX or HMX. The FIG. 1 invention embodiment includes a liner 50 that is formed into a truncated cone. The liner 50 substance may be an alloy of copper and lead, for example. In some cases, a thin sheet, 0.050", for example, of the alloy is mechanically formed to the frusto-conical configuration. Other methods of liner fabrication may provide a mixture of metal powders that is pressed or sintered to the frusto-conical form. In either case, the frusto-conical liner 50 is formed with open circular zones for the apex 62 and base 64 as illustrated by FIG. 6.

This frusto-conical liner 50 is placed in a press mold fixture with a portion of the fixture wall bridging the liner apex opening 62. A precisely measured quantity of powdered explosive material such as RDX or HMX is distributed within the internal cavity of the mold intimately against the interior liner surface and the fixture wall bridging the apex opening 62. The lower end plate 48 is place over the explosive powder and the assembly subjected to a specified compression pressure. This pressed lamination comprises a half section of the cutter assembly 40. The upper half section is identically formed except for the booster aperture 70 along the central axis 13 of the upper end plate 46. A complete cutter assembly comprises the contiguous union of the apex zones 62 respective to the lower and upper half sections along the juncture plane 72.

Distinctively, the end plates 46 and 48 of the FIG. 1 embodiment each include an axial aperture 70 and 74 of about 0.125" diameter. These apertures 70 and 74 are charged with an initiation booster explosive 78 such as Primer HMX. There is no independently loaded booster case for the FIG. 1 embodiment. The booster charge 78 in the apertures 70 and 74 is terminated at the respective aperture/cutting charge interface 66 and 76. Although the original explosive initiation point of the cutting charge 60 only occurs at the interface 66 with the upper end plate aperture 70, that is because only the upper booster charge 78 is in proximity with the detonator 31. To prevent orientation error in the field while loading a cutter housing, therefore, both end plates 46 and 48 are charged with booster explosive 78. Consequently, there is no oriented up or down to the charge. Regardless of which orientation the shaped charge assembly is given when inserted in the housing 20, the detonator 31 will engage a booster charge 78.

Loading the booster charge 78 directly into the end plates 46 and 48 provides certain manufacturing and field assembly advantages. The field assembly steps of inserting a booster cartridge after placing the shaped charge assembly 40 in the housing are eliminated. The material logistics of separately packaged booster cartridges is also eliminated. However, to assure a symmetric application of explosive forces on the opposing faces of the V-grooved liner, the cutting charge initiation point 66 should be within a critical initiation distance of about 0.050" to about 0.100" from the juncture plane 72 for a 2.50" cutter. The critical initiation distance may be increased or decreased proportionally for other sizes. The velocity or intensity of the booster explosion as influenced by the charge properties or the shape of the booster vent 82 as explained relative to FIG. 2 may also influence the critical initiation distance.

Figure 2:
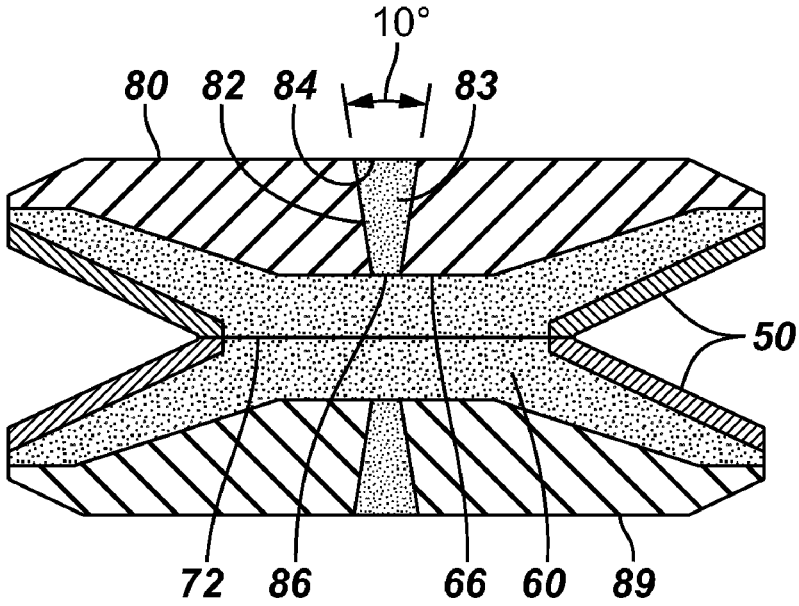
FIG. 2 is a cross-section of a second embodiment of a SC cutter unit

A modification of the FIG. 1 embodiment is represented by FIG. 2 showing the end plates 80 and 89 as having a tapered booster vents 82. Typical of this embodiment, the end plate booster vents may have a taper angle of about 10° between an approximately 0.080" inner orifice diameter 86 to an approximately 0.125" diameter outer orifice diameter 84. The taper angle, also characterized as the included angle, is the angle measured between diametrically opposite conical surfaces in a plane that includes the conical axis.

The tapered booster vent is intimately charged with booster explosive. Original initiation of the tapered booster charge occurs at the plane of the outer orifice 84 having initiation proximity with a detonator 31. The initiation shock wave propagates inwardly toward the inner orifice plane 86. As the shock wave progresses along the tapered booster vents 82, the concentration of shock wave energy intensifies due to the progressive increase in confinement of the explosive energy. Consequently, the tapered booster charge shock wave strikes the cutter charge 60 at the inner orifice plane 86 with an amplified impact.

Figure 3:
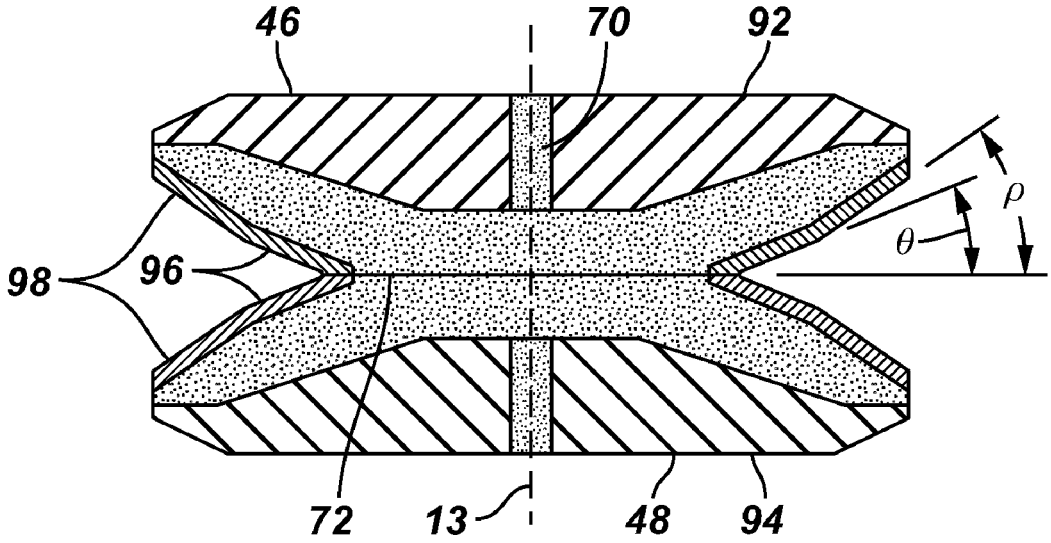
FIG. 3 is a cross-section of a third embodiment of a SC cutter unit.

The FIG. 3 embodiment of the invention comprises a shaped charge having upper and lower end plates 46 and 48 corresponding to the FIG. 1 embodiment. The liner 90 of each shaped charge cutter half section 92 and 94, however, is a composite of two frusto-cones 96 and 98. The innermost frusto-cone 96 may diverge from the juncture plane 72 by an angle θ of about 25° to about 32°. The outermost frusto-cone 98 may diverge from the juncture plane 72 by an angle ρ of about 40° to about 70°.

Figure 4:
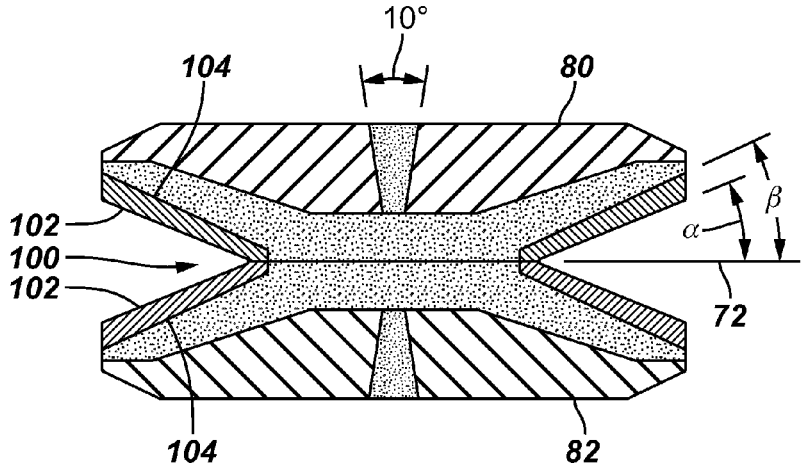
FIG. 4 is a cross-section of a fourth embodiment of a SC cutter unit.

FIG. 4 of the invention illustrates an embodiment having upper and lower end plates 80 and 82 corresponding to those of FIG. 2 but differing with a tapered thickness section of the cutter liner 100. The liner thickness increases progressively from the apex opening 62 to the base opening 64. For example, the inner cone surface 102 may extend from the juncture plane 72 at an angle α of about 30°. The outer conical surface 104 of the liner 100 may diverge from the juncture plane 72 at an angle β that is about 0.50° to about 1.50° greater than the angle α.

Figure 5:
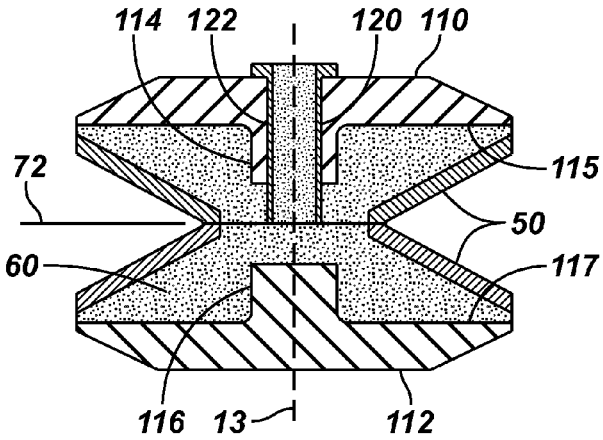
FIG. 5 is a cross-section of a fifth embodiment of a SC cutter unit.

The FIG. 5 embodiment of the invention differs significantly from the foregoing embodiments, first with the interior configuration of the respective end plates 110 and 112. Each have substantially cylindrical bosses 114 and 116 projecting inwardly from the substantially planar inside surfaces 115 and 117. Neither boss 114 nor boss 116 projects to the juncture plan Distinctively, the upper end plate 110 is axially bored for an aperture 120 of about 0.080" to about 0.125" diameter. The aperture 120 receives a booster cartridge 122 having a brass tube wall, for example, wall of about 0.010" to about 0.030". The booster cartridge 122 projects from the inner end of the aperture 120 to the juncture plane 72 of the cutter explosive 60.

Although several preferred embodiments of the invention have been illustrated in the accompanying drawings and describe in the foregoing specification, it will be understood by those of skill in the art that additional embodiments, modifications and alterations may be constructed from the invention principles disclosed herein. These various embodiments have been described herein with respect to cutting a "pipe." Clearly, other embodiments of the cutter of the present invention may be employed for cutting any tubular good including, but not limited to, pipe, tubing, production/casing liner and/or casing. Accordingly, use of the term "tubular" in the following claims is defined to include and encompass all forms of pipe, tube, tubing, casing, liner, and similar mechanical elements.

Having thus described the preferred embodiments, the invention is claimed as follows:

1. A shaped charge tubing cutter comprising a pair of substantially matched explosive units, each unit comprising a first explosive material that is formed intimately against a metallic liner, said liner being configured substantially about an axis of revolution, a first increment of said liner being configured substantially to the shape of a first conical frustum between a first normally truncated apex and a first normally truncated base, a second increment of said liner being configured substantially to the shape of a second conical frustum between a second normally truncated apex and a second normally truncated base, the truncated base of said first conical frustum being merged with the truncated apex of said second conical frustum, said first explosive material being substantially confined between said liner and a metallic end plate having a perimeter about said axis of revolution that substantially corresponds to a perimeter of said second truncated base, said units being joined coaxially at said first truncated apex with a first explosive material interface along a substantially common juncture plane.

2. A shaped charge tubing cutter as described by claim 1 wherein said first conical frustum diverges from said juncture plane at an angle of about 25° to about 32°.

3. A shaped charge tubing cutter as described by claim 2 wherein said second conical frustum diverges from said junction plane at an angle of about 40° to about 70°.

4. A shaped charge tubing cutter as described by claim 1 wherein said second conical frustrum diverges from said juncture plane at an angle that is greater than an angle at which said first conical frustrum diverges from said juncture plane.

* * * * *